US005269327A

United States Patent [19]

Counts et al.

[11] Patent Number: 5,269,327

[45] Date of Patent: Dec. 14, 1993

[54] ELECTRICAL SMOKING ARTICLE

[75] Inventors: Mary E. Counts; Bernard C. LaRoy; D. Bruce Losee, Jr., all of Richmond; Constance H. Morgan; Ulysses Smith, both of Midlothian; F. Murphy Sprinkel, Jr., Glen Allen; Francis V. Utsch, Midlothian, all of Va.

[73] Assignee: Philip Morris Incorporated, New York, N.Y.

[21] Appl. No.: 741,736

[22] Filed: Aug. 7, 1991

Related U.S. Application Data

[63] Continuation of Ser. No. 444,746, Dec. 1, 1989, Pat. No. 5,060,671.

[51] Int. Cl.[5] ..... A24F 47/00

[52] U.S. Cl. ..... 131/194; 131/195; 131/196; 131/335; 131/273; 131/128; 131/200.14; 131/202.21; 131/203.26; 131/203.27

[58] Field of Search ..... 131/335, 194, 195, 196; 128/200.14, 202.21, 203.26, 203.27

[56] References Cited

U.S. PATENT DOCUMENTS

| | | |
|---|---|---|
| 1,771,366 | 7/1930 | Wyss et al. . |
| 1,968,509 | 7/1934 | Tiffany . |
| 2,057,353 | 10/1936 | Whittemore, Jr. . |
| 2,442,004 | 5/1948 | Hayward-Butt . |
| 2,974,669 | 3/1961 | Ellis . |
| 3,200,819 | 8/1965 | Gilbert . |
| 3,363,633 | 1/1968 | Weber . |
| 3,402,723 | 9/1968 | Hu . |
| 3,482,580 | 12/1969 | Hollabaugh . |
| 3,804,100 | 4/1974 | Fariello . |
| 3,889,690 | 6/1975 | Guarnieri . |
| 4,016,061 | 4/1977 | Wasa et al. . |
| 4,068,672 | 1/1978 | Guerra . |
| 4,077,784 | 3/1978 | Vayrynen . |
| 4,131,119 | 12/1978 | Blasutti . |
| 4,141,369 | 2/1979 | Burruss . |
| 4,164,230 | 8/1979 | Pearlman . |
| 4,193,411 | 3/1980 | Faris et al. . |
| 4,215,708 | 8/1980 | Bron . |
| 4,219,032 | 8/1980 | Tabatznik et al. . |
| 4,246,913 | 1/1981 | Odgen et al. . |
| 4,256,945 | 3/1981 | Carter et al. . |
| 4,259,970 | 4/1981 | Green, Jr. . |
| 4,303,083 | 12/1981 | Burruss, Jr. . |
| 4,393,884 | 7/1983 | Jacobs . |
| 4,431,903 | 2/1984 | Riccio . |
| 4,436,100 | 3/1984 | Green, Jr. . |
| 4,463,247 | 7/1984 | Lawrence et al. . |
| 4,562,337 | 12/1985 | Lawrence . |
| 4,570,646 | 2/1986 | Herron . |
| 4,580,583 | 4/1986 | Green, Jr. . |
| 4,621,649 | 11/1986 | Osterrath . |

(List continued on next page.)

FOREIGN PATENT DOCUMENTS

| | | |
|---|---|---|
| 1202378 | 3/1986 | Canada . |
| 87/104459 | 2/1988 | China . |
| 0295122 | 12/1988 | European Pat. Off. . |
| 0358002 | 3/1990 | European Pat. Off. . |
| 0358114 | 3/1990 | European Pat. Off. . |
| 3640917A1 | 8/1988 | Fed. Rep. of Germany . |
| 3735704A1 | 5/1989 | Fed. Rep. of Germany . |
| 61-68061 | 4/1986 | Japan . |
| WO86/02528 | 4/1986 | PCT Int'l Appl. . |
| 2132539 | 7/1984 | United Kingdom . |
| 2148079 | 5/1985 | United Kingdom . |
| 2148676 | 5/1985 | United Kingdom . |

OTHER PUBLICATIONS

Excerpt from "NASA Tech Briefs," Jul./Aug. 1988, p. 31.

*Primary Examiner*—V. Millin
*Assistant Examiner*—J. Doyle
*Attorney, Agent, or Firm*—Jeffrey H. Ingerman

[57] ABSTRACT

An article is provided in which a tobacco flavor medium is electrically heated to evolve inhalable tobacco flavors or other components in vapor or aerosol form. The article has a plurality of charges of the tobacco flavor medium which are heated sequentially to provide individual puffs.

3 Claims, 12 Drawing Sheets

U.S. PATENT DOCUMENTS 4,623,401 11/1986 Derbyshire et al. .
4,637,407 1/1987 Bonanno et al. .
4,659,912 4/1987 Derbyshire .
4,771,796 9/1988 Myer .
4,776,353 10/1988 Lilja et al. .
4,837,421 6/1989 Luthy .
4,846,199 7/1989 Rose .
4,848,376 7/1989 Lilja et al. .
4,874,924 10/1989 Yamamoto et al. .
4,877,989 10/1989 Drews et al. .
4,922,901 5/1990 Brooks et al. .
4,945,931 8/1990 Gori .
4,947,874 8/1990 Brooks et al. .
4,947,875 8/1990 Brooks et al. .

FIG. 7A
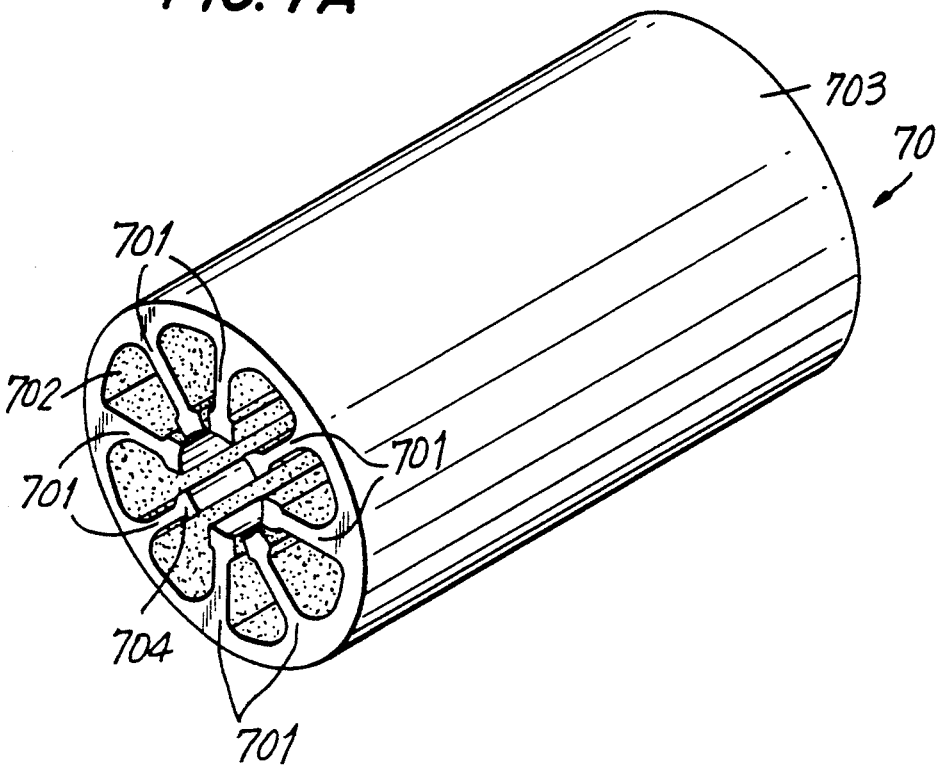
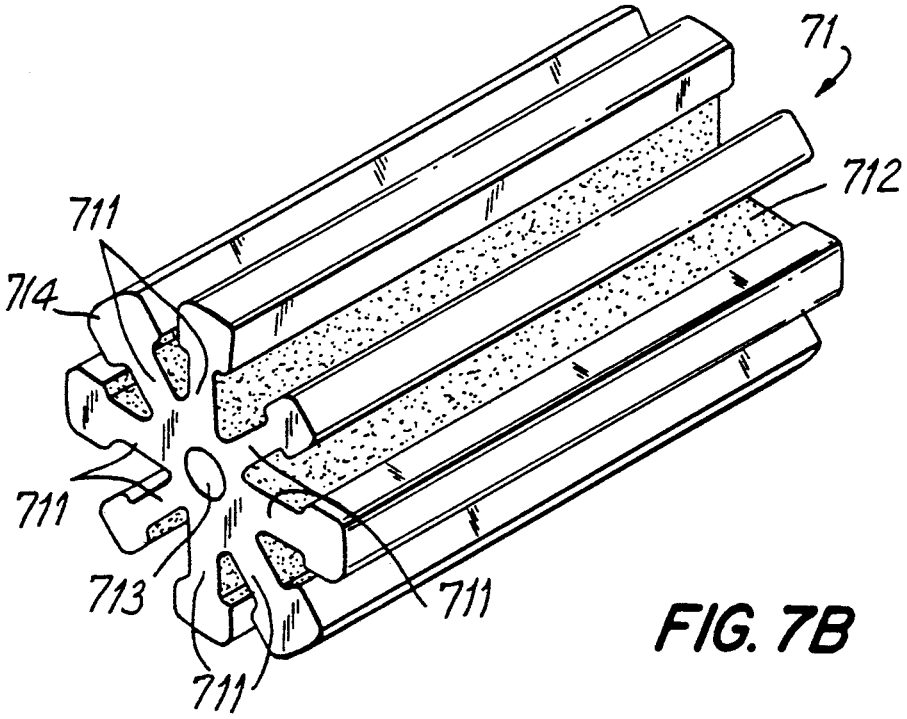
FIG. 7B

FIG. 7C
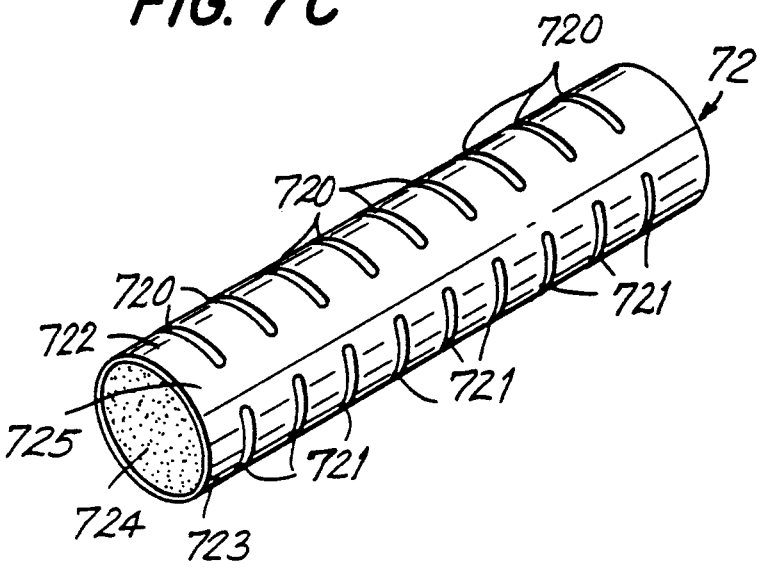
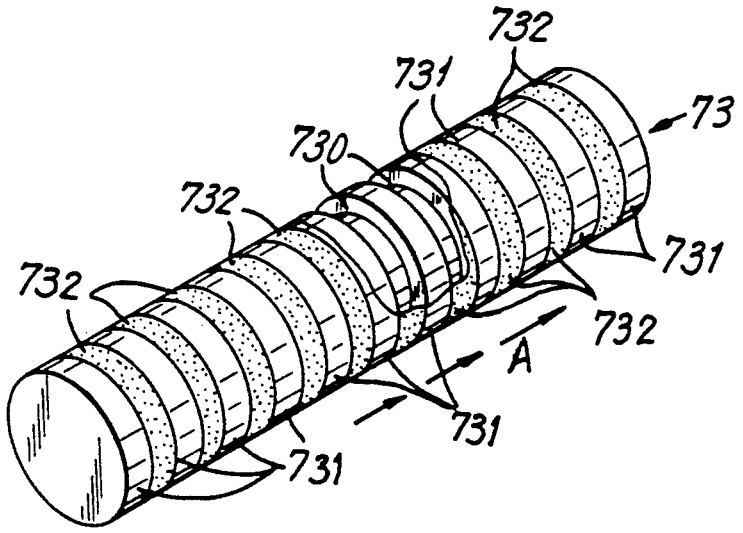
FIG. 7D

FIG. 7H
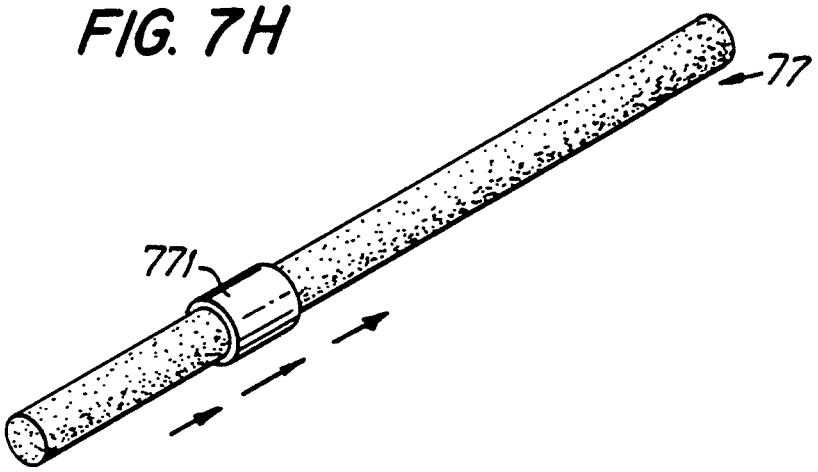
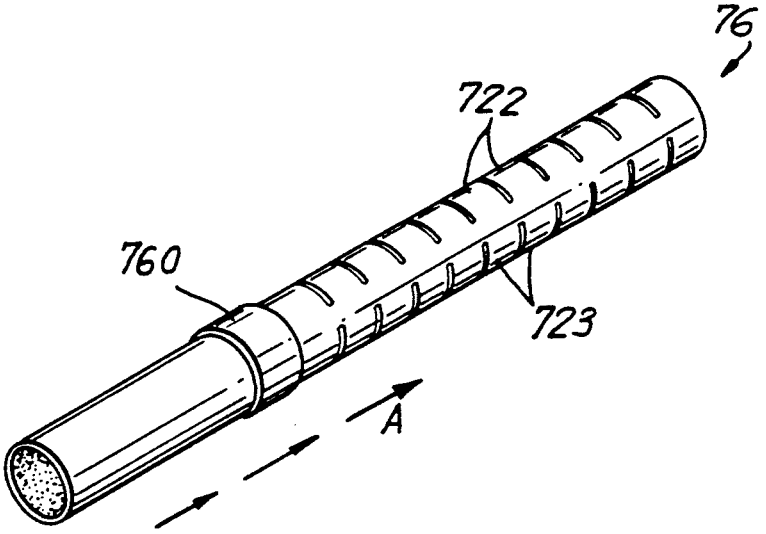
FIG. 7G.

ELECTRICAL SMOKING ARTICLE

CROSS REFERENCE TO RELATED APPLICATION

This application is continuation of copending, commonly-assigned United States patent application Ser. No. 07/444,746, filed Dec. 1, 1989, now U.S. Pat. No. 5,060,671.

BACKGROUND OF THE INVENTION

This invention relates to articles in which tobacco flavor media are heating but not burned to release tobacco flavors. More particularly, this invention relates to electrically heated smoking articles.

It is known to provide smoking articles in which a flavor bed of tobacco or tabacco-derived material is heated, with combustion of tobacco, to release tabacco flavors without producing all the normal products of tabacco combustion. For example, it is known to provide a smoking article having a bed tabacco-derived material and a combustible heat source. A smoker draws air through or around the heat source, heating it, and the heated air passes through the flavor bed, releasing tobacco flavors that are drawn into the smoker's mouth. The heat source temperature, is dependent on how the smokers uses the article, so, that the flavor release rate varies widely from smoker to smoker and from article to article for a particular smoker.

Articles that produce the taste and sensation of smoking by heating tobacco electrically are also known. However, in some known electrically heated smoking articles the temperature was not consistent because the output of the electrical power source was not well regulated, so that the release of flavors also was not consistent. In other known electrically heated smoking articles the power source was external to the article and inconvenient.

It would be desirable to be able to provide an electrical smoking article which operates at a controlled temperature to produce a predetermined release of flavor with each puff.

It would also be desirable to be able to provide such an article which consistently for each puff reaches its operating temperature quickly and remains at that temperature long enough to release the desired flavors, without overheating and causing burning of its flavor source, while at the same time minimizing the consumption of energy.

It would further be desirable to be able to provide such an article which is self-contained.

It would still further be desirable to be able to provide such an article which can have the appearance of a conventional cigarette, but produces neither sidestream smoke nor ash, and is not hot between puffs.

SUMMARY OF THE INVENTION

It is an object of this invention to provide an electrical smoking article which operates at a controlled temperature to produce a consistent release of flavor with each puff.

It is also an object of this invention to provide such an article which consistently for each puff reaches its operating temperature quickly and remains at that temperature long enough to release the desired flavors, without overheating and causing burning of its flavor source, while at the same time minimizing the consumption of energy.

It is a further object of this invention to provide such an article which is self-contained.

It is still a further object of this invention to provide such an article which can have the appearance of a conventional cigarette, but produces neither sidestream smoke nor ash, and is not hot between puffs.

In accordance with this invention, there is provided electrical smoking article for delivering to a consumer a flavor-containing substance. The article comprises a plurality of charges of tobacco flavor medium, electrical heating means for individually heating each of the plurality of charges, a source of electrical energy for powering the electrical heating means, and control means for applying the electrical energy to the electrical heating means to individually heat one of the plurality of charges. Each of the charges, when heated, delivers a quantity of tobacco flavor substance to the smoker.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIGS. 7A–7K are perspective views of various embodiments of heaters for use in the present invention;

DETAILED DESCRIPTION OF THE INVENTION

Figure 1:
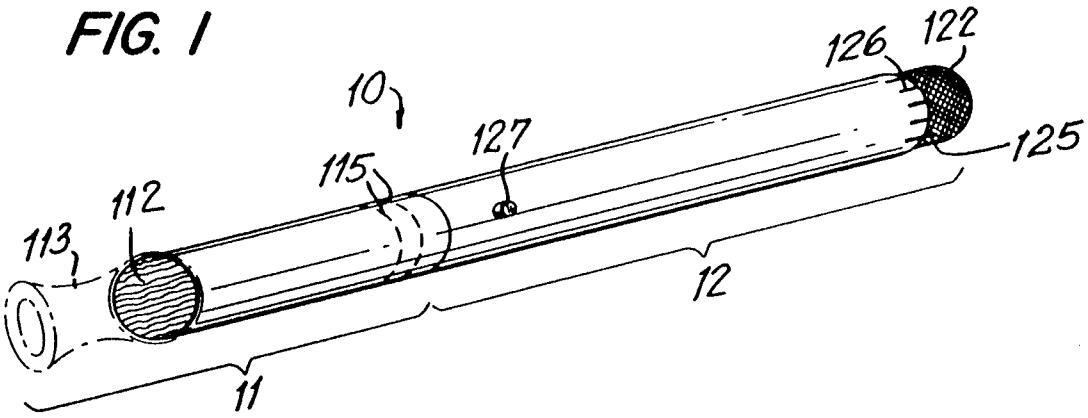
FIG. 1 is a perspective view of a first embodiment of an article according to the present invention.

The basic electrical smoking article of the present invention includes a source of electrical energy, an electrical heater or heaters, electrical or electronic controls for delivering electrical energy from the source of electrical energy to the heaters in a controlled manner, and a tobacco flavor medium in contact with the heater. When the heater heats the tobacco flavor medium, tobacco flavor substance—i.e., a vapor or aerosol, or mixture thereof, containing tobacco-flavored vapors or aerosols or other vapor or aerosol components—is generated or released and can be drawn in by the smoker consumer. (In the discussion that follows, either of the words "generate" or "release", when used alone, includes the other, and the word "form", when used in connection with the phrase "tobacco flavor substance," means "generate or release.")

The tobacco flavor medium can be any material that, when heated, releases a tobacco flavor substance. Such materials can include tobacco condensates or fractions thereof (condensed components of the smoke produced by the combustion of tobacco, leaving flavors and, possibly, nicotine), or tobacco extracts or fractions thereof, deposited on an inert substrate. These materials when heated generate or release a tobacco flavor substance (which may include nicotine) which can be drawn in by the smoker. The tobacco flavor medium can also be unburned tobacco or a composition containing unburned tobacco that, when heated to a temperature below its burning temperature, generates or releases a tobacco-flavor substance. Any of these tobacco flavor generating media can also include an aerosol-forming material, such as glycerine or water, so that the smoker has the perception of inhaling and exhaling "smoke" as in a conventional cigarette. A particularly preferred material is a composition such as that described in copending, commonly-assigned U.S. patent application Ser. No. 222,831, filed Jul. 22, 1988, hereby incorporated by reference in its entirety, which describes pelletized tobacco containing glycerine (as an aerosol-forming ingredient) and calcium carbonate (as a filler). As used in the present invention, the composition, instead of being formed into pellets, would be deposited as a coating, in conjunction with adhesion agents such as citrus pectin, on a heater or on an inert substrate in contact with a heater.

The tobacco flavor medium is divided into individual charges, each representing one puff of the article. It is possible to mimic a conventional cigarette by providing a number of charges of tobacco flavor medium equal to an average number of puffs per cigarette, e.g., eight to ten puffs. Although the article does not decrease in length like a conventional cigarette as it is smoked, it is possible to make the article in varying lengths, with different numbers of puffs. By providing individual charges for each puff, one reduces the total amount of tobacco flavor generating medium that must be provided, as compared with a single larger charge that would be electrically heated or reheated once for each of several puffs. The amount of electrical energy needed to heat a number of individual charges is also less than the amount needed to heat an entire large bed several times while also maintaining a controlled lower bed temperature between puffs, as necessary.

The portion of the article according to the present invention that contains the heaters and the tobacco flavor medium is preferably a replaceable plug-in unit, so that when all of the charges have been heated, the spent plug-in unit can be discarded and a new one inserted. The controls and power source could be retained.

Figure 2:
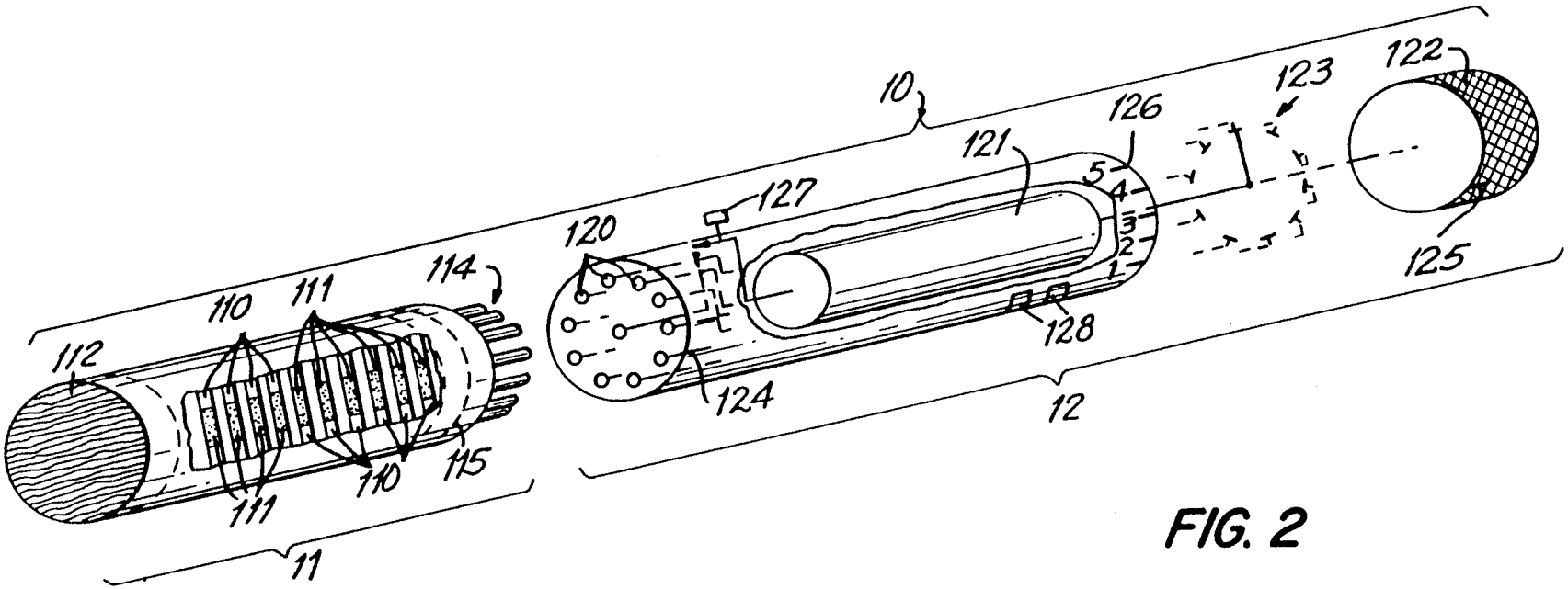
FIG. 2 is a partially fragmentary exploded perspective view of the article of FIG. 1.

One embodiment of article 10 according to the invention is shown in FIGS. 1 and 2. Article 10 is the simplest form of article according to the present invention, and includes heater/flavor/mouthpiece section 11 and power and control section 12. Section 11 includes a plurality of heaters 110, each having deposited on its surface a quantity of tobacco flavor medium 111. The heater configuration shown in FIG. 2 is illustrative only. Different possible heater configurations will be discussed below. Preferably, there is a segment of filter material 112, such as conventional cellulose acetate or polypropylene cigarette filter material, possible in consideration with paper-wrapped tobacco rod sections, at the mouth end of section 11, both for aesthetic purposes as well as to provide appropriate filtration efficiency and resistance-to-draw to the system. In addition, mouthpiece 113 can optionally be included.

As shown in FIG. 2, there are ten heaters 110 in section 11. There are also eleven contact pins 114 extending from section 11 remote from its mouth end—one common pin and ten pins connected to individual heaters 110—that fit into eleven sockets 120 on section 12 to make electrical contact between heaters 110 and power source 121, the nature of which will be discussed in more detail below.

A knurled knob 122 is provided at the remote end of section 12 to allow the smoker to select one of the heaters 110. Knob 122 controls a single-pole ten position rotary switch 123 connected by wires 124 to sockets 120. Index mark 125 on knob 122 and graduations 126 on the body of section 12 assist the smoker in selecting the next heater 110. To operate article 10, the smoker selects a heater 110 using knob 122 and presses momentary-on pushbutton switch 127 to complete the circuit and energize the selected heater 110 to initiate heating. Tobacco flavor medium 111, thus heated, can release or generate a tobacco flavor substance. The consumer draws in the flavor-contining substance along with air drawn through perforations 115 in the outer wrapper of section 11 or 12, which could be conventional cigarette paper or tipping paper. Air may also enter through the end of section 12 remote from the mouth end through channels that may be provided for that purpose, carrying the air around power source 121 and around other internal components of section 12. What is important is that the air enter section 11 at a point at which it can fully sweep heaters 110 to carry the maximum amount of tobacco flavor substance to the mouth of the smoker.

When all ten charges in section 11 have been heated, section 11 is spent, and can be unplugged from article 10 and a new section 11 can be plugged in. Section 12 as envisioned is reusable.

Figure 3:
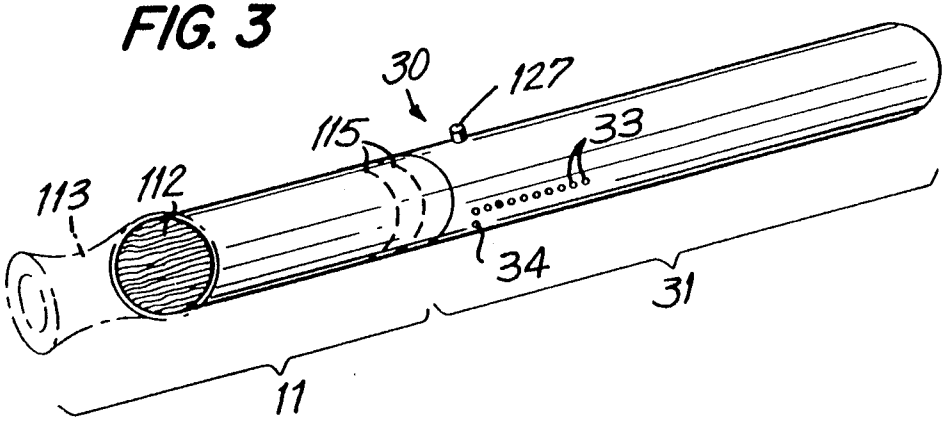
FIG. 3 is a perspective view of a more preferred second embodiment of an article according to the present invention.

In article 10, it is possible that the smoker will select a particular heater 110 more than once, giving rise to the possibility of reheating the tobacco flavor medium and producing less preferred vapor or aerosol compounds, unless knob 122 is designed so that it can only be rotated in one direction and only for one complete revolution. But in that case, its ability to rotate would have to be restored when section 11 is replaced, which is mechanically complex to achieve. Therefore, a more preferred embodiment 30 of an article according to the present invention, shown in FIGS. 3 and 4, includes controls that automatically select which charge will be heated, as well as the duration of heating.

Article 30 includes a heater/flavor/mouthpiece section 11 identical to section 11 of article 10. However, power and control section 31 contains electronic control circuit 32 (described in more detail below) in place of mechanical switch 123 of power and control section 12 of article 10. Control circuit 32, in response to depression of pushbutton 127, selects one of charges 111 that has not previously been used, and supplies power from power source 121 to the associated heater 110 for a predetermined duration. After all ten charges 111 have been used, circuit 32 no longer supplies power to any heater until spent section 11 is replaced by a fresh unit. Optionally, control circuit 32 also locks out pushbutton 127 for a predetermined lockout period after each depression, so that heaters 110 are not energized too soon one after the other.

Articles according to the present invention do not decrease in length like conventional cigarettes do as they are smoked, because they do not burn. Therefore, in order to provide some indication to a smoker of how much of article 30 has been used or remains to be used, visual indicators 33, which can be a series of ten light emitting diodes or a bar graph or similar indicator, under the control of circuit 32, are preferably provided to display either how many of charges 111 have been used or how many remain. Similarly, there is no glowing coal as in a conventional cigarette to indicate to the smoker that the article is operating. Optionally, an additional light emitting diode 34 or similar indicator, also under the control of circuit 32, can be provided to show when one of heaters 110 is energized. An additional indicator or indicators (not shown) may also be provided to show that the lockout period is in effect or that it is over.

Figure 5:
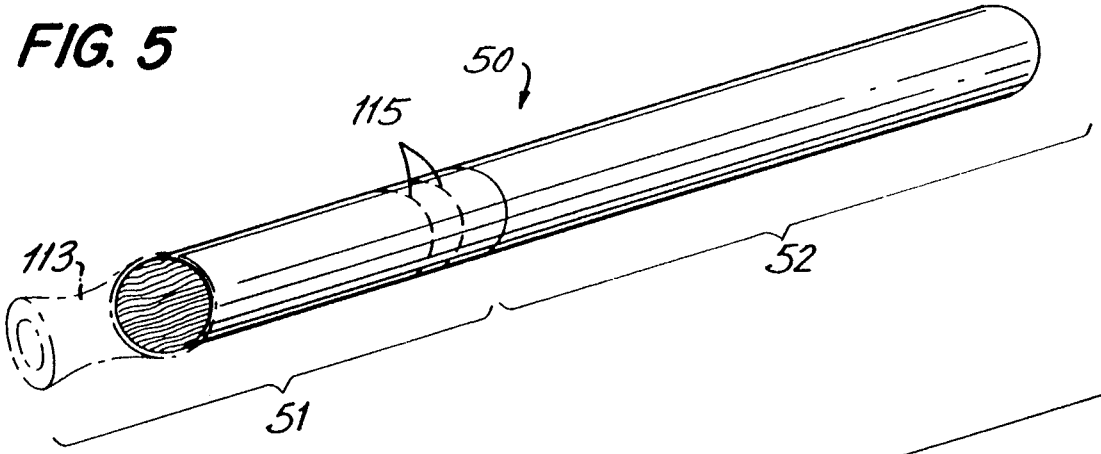
FIG. 5 is a perspective view of a still more preferred article according to the present invention.
Figure 6:
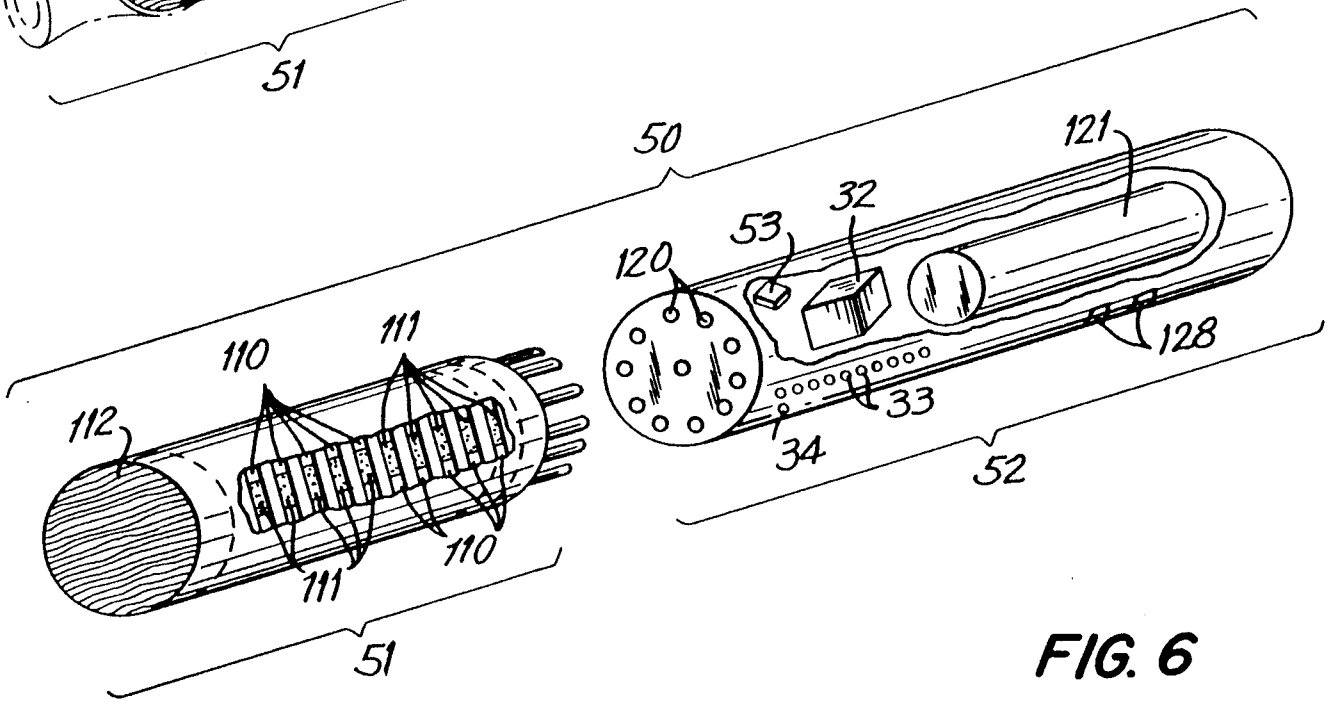
FIG. 6 is an exploded perspective view of the article of FIG. 5.

In the most particularly preferred embodiment, an article according to this invention does not have a pushbutton 127, but is responsive to the smoker's drawing on the article, similarly to a conventional cigarette. Therefore, article 50, shown in FIGS. 5 and 6, is identical to article 30, except that section 52 lacks pushbutton 127. Pushbutton 127 is replaced by a switch 53 in section 52 that is sensitive either to pressure changes or air flow changes as the smoker draws on article 50. It has been found that when a Model 163PC01D36 silicon sensor, manufactured by the MicroSwitch division of Honeywell, Inc., Freeport, Ill., is used in a preferred embodiment of the invention, the appropriate heater is activated sufficiently rapidly by the change in pressure when the smoker draws on article 50. In addition, flow sensing devices, such as those using hot-wire anemometry principles, have been successfully demonstrated to actuate the appropriate heater 110 sufficiently rapidly after sensing a change in air flow.

The heaters 110 used in the present invention would have to heat the tobacco flavor medium to a temperature in the range of from about 100° C. to about 600° C., and preferably from about 200° C. to about 500° C., and more preferably from about 300° C. to about 400° C., to release the desired flavors from the tobacco flavor medium. To release or generate the desired flavors from the tobacco flavor medium, heater 110 should be energized for a duration of from about 0.1 second to about 4 seconds, preferably from about 0.5 second to about 1.5 seconds, and more preferably from about 0.8 second to about 1.2 seconds. The optimum temperature and total heating time depend on the heater mass, the mass of the tobacco flavor medium 111 on heater 110, the configuration of heater 110 and tobacco flavor medium 111 thereon, and the thermal/physical properties of heater 110 and tobacco flavor medium 111. The heating conditions are most preferably chosen to prevent burning of tobacco flavor medium 111. At the same time, heaters 110 are preferably part of replaceable heater/flavor/mouthpiece section 11, and therefore they need not be capable of more than one use.

Figure 4:
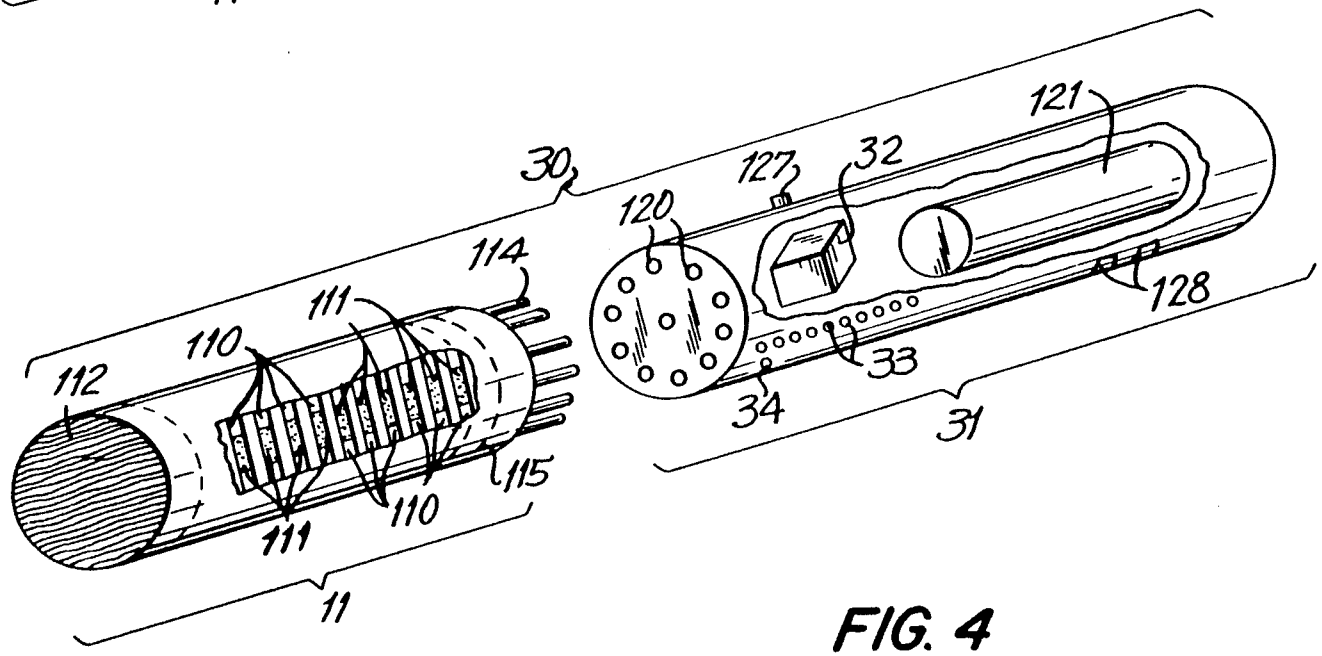
FIG. 4 is an exploded perspective view of the article of FIG. 3.

The linear array of heaters 110 shown in FIGS. 2, 4 and 6 is shown for ease of illustration only, and does not necessarily represent the preferred embodiment of heaters to be used in the present invention. Possible heaters for use in the present invention are described in copending, commonly-assigned U.S. patent application Ser. No. 07/444,569, (now U.S. Pat. No. 5,093,894), filed concurrently with patent application Ser. No. 07/444,746 and hereby incorporated by reference in its entirety. A number of different possible additional heater configurations are shown in FIGS. 7A–7K. The different configurations reflect both mechanical considerations—e.g., ease of manufacture—and materials considerations—e.g., the effect of the heater material on the composition of the tobacco flavor substance.

For example, linear heaters 110 shown in FIGS. 2, 4 and 6 could be bars or mesh of stainless steel or other suitable metals or ceramics, although the tobacco flavor medium would adhere more readily to a mesh.

A preferred material for the heaters is graphite. Graphite heaters, possibly compounded with other forms of carbon to provide the desired electrical resistance and therefore the desired heating, are stable and non-reactive, and can be molded, extruded or machined into many forms and attached, by suitable contacts, to power source 121. For example, a cylindrical graphite structure 70 as shown in FIG. 7A can be formed with a number of inwardly directed vanes 701 equal to the desired number of puffs. The inner surfaces 702 of structure 70 can be coated with the tobacco flavor medium. By connecting one pole of power source 121 to the outer surface 703 of structure 70, and sequentially connecting the other pole to the inwardmost edge 704 of each vane 701, one can heat each vane 701 to the desired temperature. Inwardmost edge 704 of each vane 701 is increased in thickness as compared to the body of vane 701 for added strength and to provide a conductive pathway to improve the unformity of electrical flow and heating across the vane to maximize the use of available heater surface area. Covering both surfaces of each vane 701 with tobacco flavor medium also maximizes the use of available heater area and, thus, heater energy. Concentrating the tobacco flavor medium further increases the amount of tobacco flavor substance generated or released per unit of expended electrical energy.

Similarly, graphite structure 71 can be provided which functions like structure 70, except that vanes 711 radiate outwardly from a central core 713, as shown in FIG. 7B. The tobacco flavor medium is deposited on the surfaces 712 between vanes 711. Power can be applied between core 713 and the outer edge 714 of the appropriate vane 711. Outer edge 714 of each vane is increased in thickness as compared to the body of vane 711 for added strength and to provide a conductive pathway as discussed above.

Each of structures 70 and 71 has eight vanes 701, 711, representing eight charges of tobacco flavor medium which provide eight puffs. The structures shown below would provide ten puffs.

Structure 72 shown in FIG. 7C is a hollow cylinder of graphite, divided by nine opposed pairs of slits 720, 721 into ten opposed pairs of segments 722, 723. The tobacco flavor medium is coated on the inner or outer surface 724 of cylinder 72. When one pole of power source 121 is connected to each of opposed segments 722, 723, heat is generated predominantly in that pair only, heating the tobacco flavor medium coated onto that pair. Although all ten pairs are interconnected at midline 725, at most a low current flows along midline 725 outside the pair being heated.

Structure 73 shown in FIG. 7D is a solid or hollow (not shown) cylinder of graphite, with ten grooves 730 formed in its surface, separating eleven lands 731. Grooves 730 are coated with tobacco flavor medium 732. By applying power source 121 across two adjacent lands 731, one heats structure 73 between those two lands 731 along with tobacco flavor medium 732 in groove 730 therebetween.

Figure 7E:
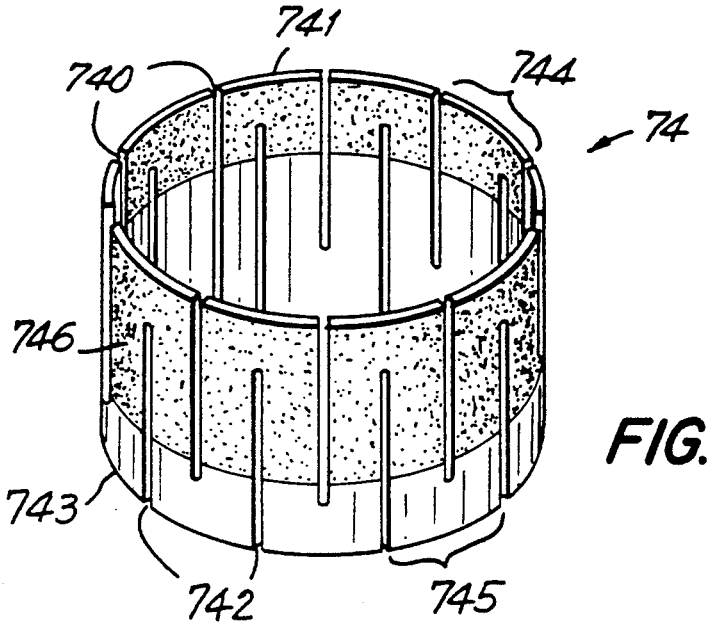

Structure 74 shown in FIG. 7E is a graphite ring divided by two interleaved sets of ten slots each, one set of slots 740 extending from one side 741 of the ring, and the other set of slots 742 extending from the other side 743 of the ring, forming ten U-shaped fingers 744 that are coated inside or outside with tobacco flavor medium 746 adjacent side 741, and ten uncoated bases 745 adjacent side 743, each base 745 connected to one leg each of two adjacent fingers 744 so that two adjacent bases 745 contact opposite ends of one finger 744. By applying power from source 121 across two adjacent bases 745 heat is generated predominantly in that the finger 744 that they contact in common, heating the tobacco flavor medium thereon.

Figure 7F:
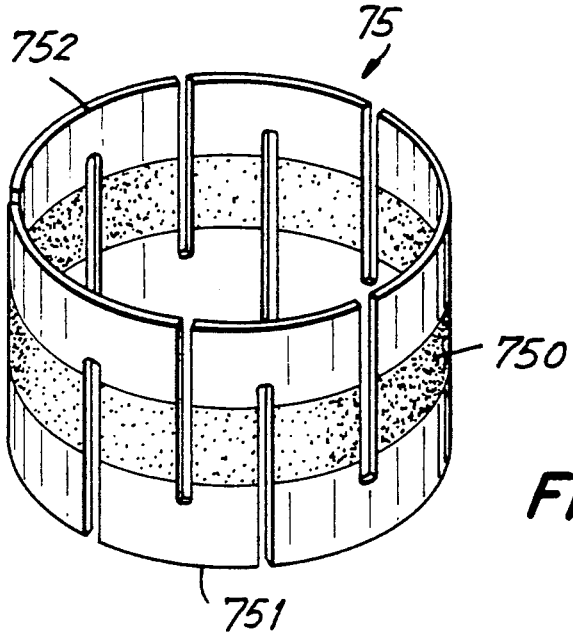

Structure 75 shown in FIG. 7F is similar to structure 74, except that it has only five each of slots 740 and 742, and the tobacco flavor medium 750 is confined to the band of overlap of slots 740 and 742, thus forming ten separate areas of tobacco flavor medium 750, as well as five bases 751 and five fingers 752. Bases 751 and fingers 752 are arranged so that when one pole of power source 121 is applied to one base 751, two areas 750 can be heated sequentially by sequentially applying the other pole of power source 121 to each of two adjacent fingers 752. To heat further areas 750, the second pole of power source 121 is left attached to the second one of fingers 752 and the first (or third) pole of power source 121 is connected to a different base 751, and so on.

Structure 76 shown in FIG. 7G is similar to structure 72 shown in FIG. 7C, except that a slidable heater 760 is provided to serially heat each pair of opposed segments 722, 723 by conduction, convection or radiation as it is moved in the direction of arrow A. Optionally, structure 703 can be indexed through stationary heater collar 760. A variant structure 77 shown in FIG. 7H is an extruded rod 770 (hollow or solid) made solely of tobacco flavor medium and components to add mechanical strength, provided with slidable heater 771. Heater 771 is similar to heater 760. The heater is moved in the direction of arrow A, either manually by the smoker, or automatically by electromagnetic or mechanical means (not shown) linked to the smoker's actuation of the heater with pushbutton 127 or with a switch activated by either pressure or airflow provided by the smoker during a puff. For example, in addition to closing electrical contacts, pushbutton 127 could also engage a mechanical ratchet (not shown). Alternatively, the closing of switch 127 (or alternative switches) could, in addition to providing current for the heaters, move a pawl which allows a spring attached to collar 760 or 771 to move the collar one position in the direction of arrow A.

Figure 7I:
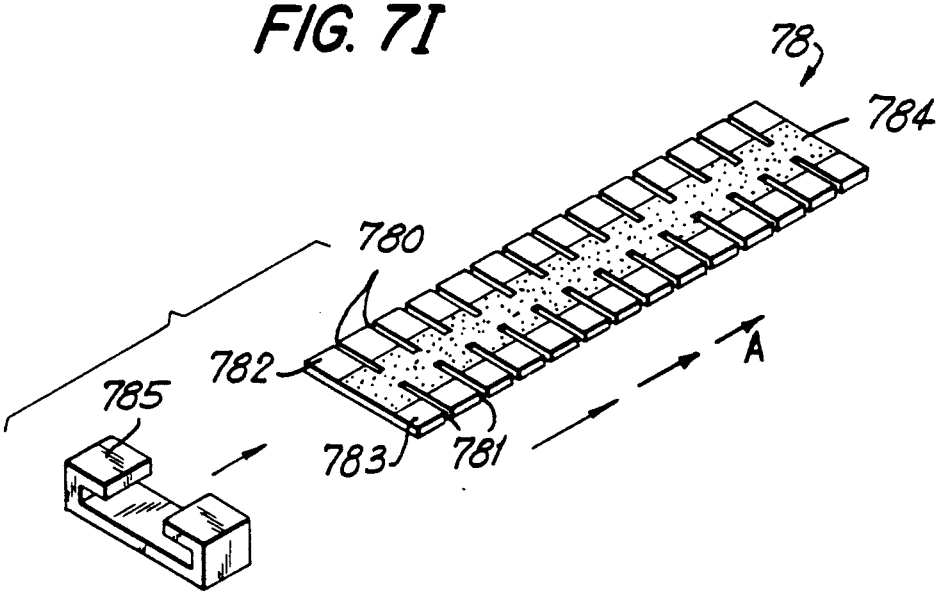
Figure 7J:
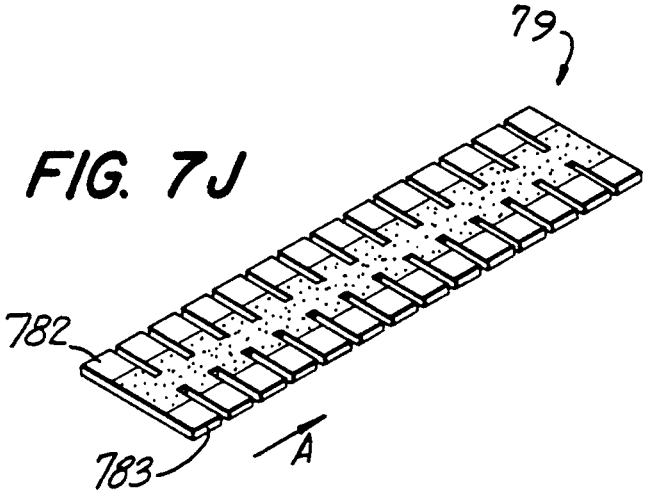
Figure 7K:
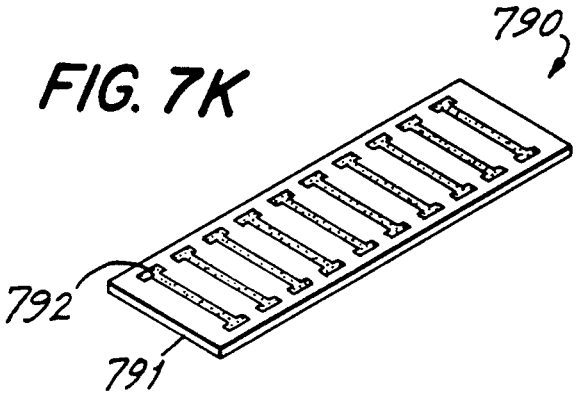

The same principle can be applied to each of the three heater structures shown in FIGS. 7I, 7J and 7K. Structure 78 of FIG. 7I is a thermally conductive substrate divided by slots 780, 781 into strips 782, 783. Applying heat to the width-wise strips defined by opposed pairs of strips 782, 783 causes heat to flow primarily to those width-wise strips, heating that section of substrate 78 and tobacco flavor medium 784 thereon. Heat is applied to strips 782, 783 by passing substrate 78 through a heater 785. The movement of substrate 78 through heater 785 in the direction of arrow A can be accomplished in any of the ways set forth above for the movement of collars 760, 771. Heater 785 can be disposable, as part of section 11, or permanent, as part of section 12, 31 or 52, with only substrate 78 being replaced as part of section 11.

Structure 79 of FIG. 7J is similar to structure 78, except that substrate 79 is made from graphite, which serves as its own heater, so that heater 785 can be omitted and replaced with electrical contacts (not shown) for applying power across strips 782, 783 of substrate 79.

Structure 790 of FIG. 7K has an inert substrate 791 on which lines 792 of tobacco flavor medium, mixed with graphite or similar material to make it conductive, are laid. Contacts similar to those used with structure 79 are used to apply power across lines 792, which, by virtue of their conductivity, form their own heaters integral with the tobacco flavor medium.

Figure 8A:
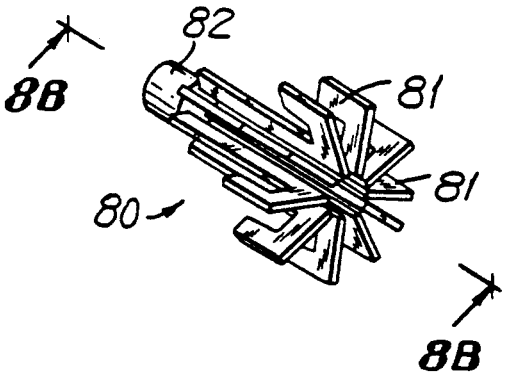
FIGS. 8A–8C are views of a particularly preferred embodiment of heaters for use in the present invention.
Figure 8B:
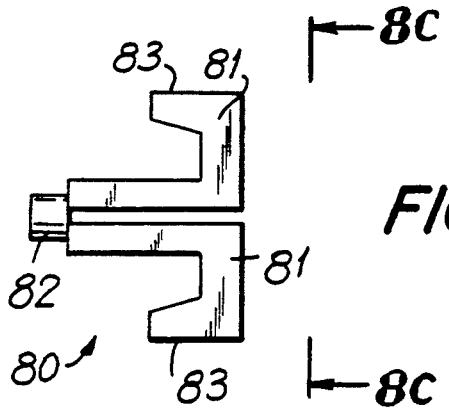
Figure 8C:
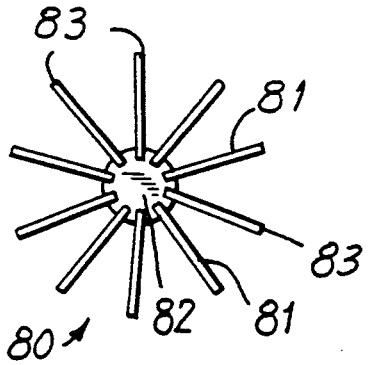

FIGS. 8A–8C show a particularly preferred embodiment of a heater structure 80 for use with the present invention. Structure 80 includes ten U-shaped heater elements 81 connected to a central hub 82. Preferably, heater elements 81 are makde of graphite. Hub 82 serves as one contact point for the application of power to each heater element 81, while outer edge 83 of each heater element 81 serves as the second contact point for that respective heater. Hub 82 is connected to one contact and outer edges 83 are connected to a series of ten contacts that are activated sequentially to sequentially heat heater elements 81. (As used herein, "sequentially" does not necessarily imply any spatial order, but only that some individual element is heated after some other individual element.)

Whatever heater design is used, it is subject to several design criteria. First, the electrical resistance of the heater should be matched to the voltage of power source 121 so that the desired rate of heating is accomplished. At the same time the resistance must be large compared to the internal resistance of power source 121 to avoid excessive losses due to the internal resistance. Second, the surface area must be sufficient to allow for support of the tobacco flavor medium with proper thickness of the tobacco flavor medium to allow rapid heating and with proper area for generation or release of vapors or aerosols containing flavors or other volatile components. Third, the thermal conductivity, heat capacity and heater mass must be such that the heat generated is conducted effectively to the tobacco flavor medium but not away from the heater to the surroundings, and such that excessive energy is not necessary to heat the heater itself.

The contact resistance between the heater material and the contacts should be kept low. If necessary, suitable materials, such as tantalum, can be compounded or coated at the contact points to lower contact resistance. Any materials added should be nonreactive at the operating temperatures.

Heater/flavor/mouthpiece section 11 preferably would contain heater elements as described above coated with tobacco flavor medium, all wrapped in a tube, which can be made of heavy paper, to allow it to be inserted by a smoker into section 12, 31 or 52.

Power source 121 preferably must be able to deliver sufficient energy to generate or release flavors or other components in vapor or aerosol form from ten charges of tobacco flavor medium, while still fitting conveniently in the article. However, the energy to be delivered is not the only criterion, because the rate at which that energy is delivered—i.e., the power—is also important. For example, a conventional AAA-sized alkaline cell contains enough energy to heat several hundred charges of tobacco flavor medium, but it is not designed to deliver the necessary energy at a high enough rate. On the other hand, nickel-cadmium (Ni-Cad) rechargeable batteries are capable of providing much greater power on discharge. A preferred power source is four N50-AAA CADNICA nickel-cadmium cells produced by Sanyo Electric Company, Ltd., of Japan. These batteries provide 1.2-volts each, for a total of 4.8 volts when connected in series. The four batteries together supply about 264 milliwatt-hours, which is sufficient to power at least one ten puff article without recharging. Of course, other power sources, such as rechargeable lithium-manganese dioxide batteries, can be used. Any of these types of batteries can be used in power source 121, but rechargeable batteries are preferred because of cost and disposal considerations associated with disposable batteries. In addition, if disposable batteries are used, section 12, 31 or 52 must be openable for replacement of the battery.

If rechargeable batteries, as preferred, are used, a way must be provided to recharge them. A conventional recharging unit (not shown) deriving power from a standard 120-volt AC wall outlet, or other sources such as an automobile electrical system or a separate portable power supply, can be used. The charge rate and controller circuitry must be tailored to the specific battery system to achieve optimal recharging. The recharging unit would typically have a socket into which the article, or at least section 12, 31 or 52, would be inserted. Contacts 128 on section 12, 31 or 52 connected to power source 121 would contact corresponding contacts in the recharging unit.

The energy content of a battery in power source 121 can be more fully exploited, despite the power or current limitation of the battery, if a capacitor is included in power source 121 as well. The discharge of the capacitor can be used to power heaters 110. Capacitors are capable of discharging more quickly than batteries, and can be charged between puffs, allowing the battery to discharge into the capacitor at a lower rate than if it were used to power heaters 110 directly.

Figure 9:
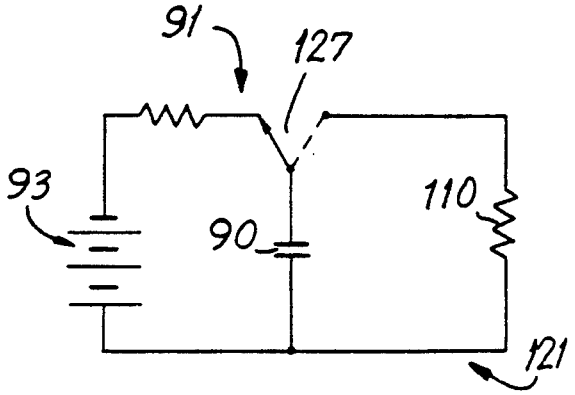
FIG. 9 is a schematic diagram of a preferred power source for use in the present invention.

An idealized schematic form of a power source 121 including a capacitor is shown in FIG. 9. Capacitor 90 is part of a series R-C circuit 91 with resistor 92, in which capacitor 90 is charged between puffs by battery 93 with a time constant RC, where R is the resistance of resistor 92 and C is the capacitance of capacitor 90. (In a real, non-ideal circuit, resistance R would also include the internal resistance of battery 93 and the impedance of capacitor C, as well as the resistance of any wires or other conductors in circuit 91.) In this embodiment, pushbutton (or pressure- or air flow-sensitive device) 127 acts as a single-pole, double-throw momentary switch that normally connects capacitor 90 to R-C circuit 91 for charging. When contact is made by depression of pushbutton 127 (or by activation of the above-mentioned devices), capacitor 90 can be disconnected from charging circuit 91 and connected to discharge across heater resistance 110.

Alternatively, power source 121 could include only capacitor 90, with no battery. In such an embodiment, contacts 128 would have to be touched to an external power source to charge capacitor 90. Capacitor 90 could be sized in such a case to require charging after each puff, or to be capable of being charged for a number of puffs (e.g., the same as the number of charges of tobacco flavor generating medium in the article). The external power source could be a specially designed ashtray or other appliance (not shown) having power contacts for mating with contacts 128. The ashtray itself could be battery powered or could contain a power supply that connects to a 120 volt AC wall outlet. Another type of external power source could be a socket provided on an automobile dashboard and connected to the electrical system of the automobile, similar to the cigarette lighter currently provided in automobiles.

In another possible embodiment, energy would be coupled to the article by magnetic or electromagnetic induction, followed by suitable rectification and conditioning prior to charging the capacitor. For example, the specially designed ashtray referred to above could contain a suitable generator for coupling magnetic or electromagnetic energy to the article.

If a capacitor is used in the article, the required capacitance is determined by the voltage available for charging and the maximum amount of energy to be stored. For example, if the voltage available is 6 volts and the amount of energy needed for a single puff is 10 joules, then the required capacitance is 0.56 farads. The capacitance needed would increase proportionally if energy for multiple puffs is to be stored. Preferably, the capacitor also has a very low internal resistance, so that the time constant for discharging into heater 110 is determined exclusively by the heater resistance and the capacitance.

Figure 10:
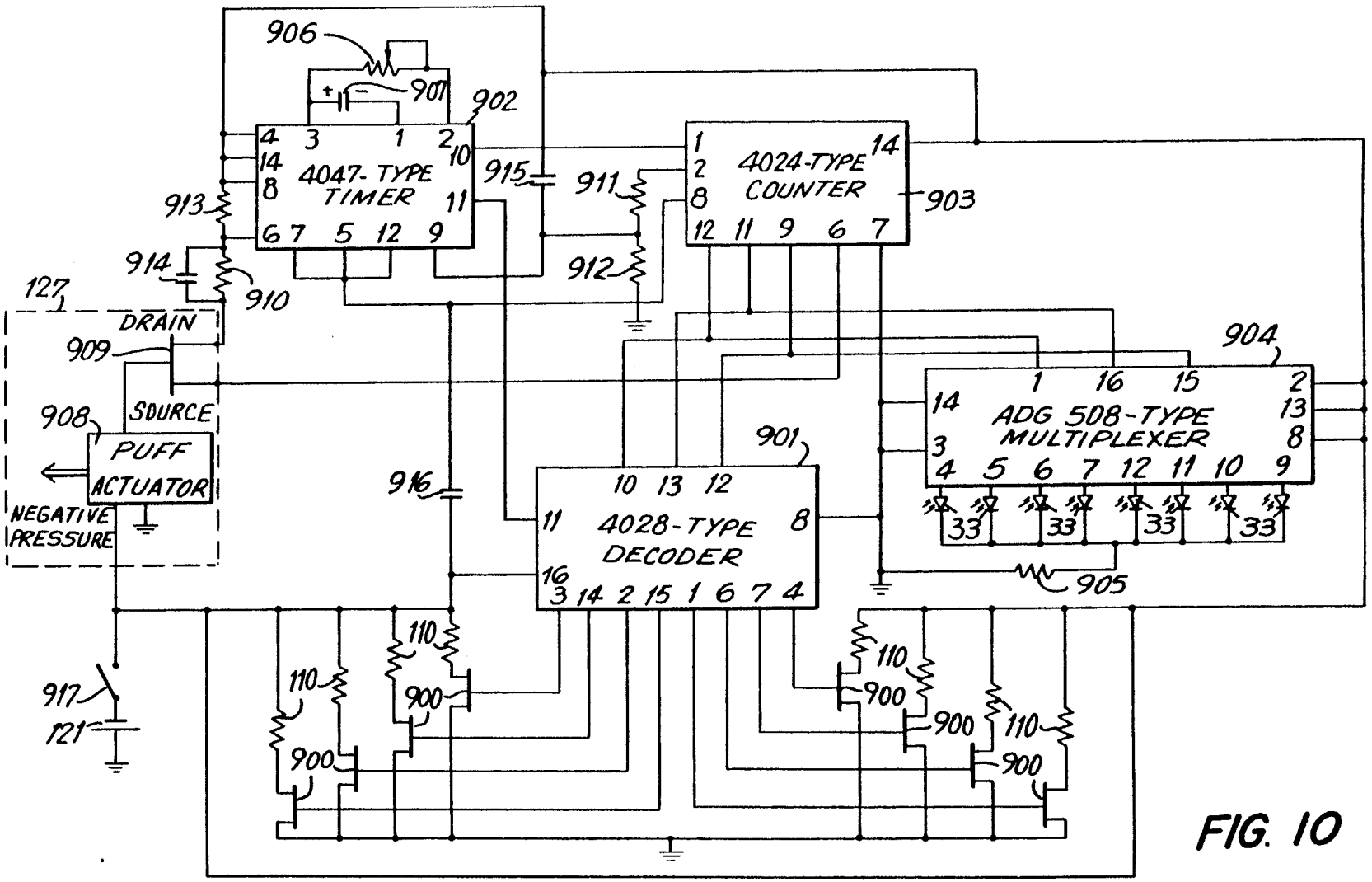
FIG. 10 is a schematic diagram of a preferred embodiment of a control circuit for use in the present invention.

The most preferred embodiment of the present invention includes control circuit 32 of FIG. 10. Control circuit 32 preferably fulfills several functions. It preferably sequences through the ten (or other number of) heaters 110 to select the next available heater 110 each time switch 127 is closed. It preferably applies current to the selected heater for a predetermined duration that is long enough to produce sufficient tobacco flavor substance for an average puff, but not so long that the charge of tobacco flavor medium can begin to burn. It preferably controls indicators 33, 34 which show how much of the article remains or has been used and when one of heaters 110 is active. In addition, it may also lock out switch 127 for a predetermined time period after each actuation to allow time to charge capacitor 90 in power source 121, and to avoid inadvertently energizing the next heater 110.

Control circuit 32 also controls the amount of total particulate matter (TPM) evolved from the tobacco flavor medium by controlling the temperature to which the tobacco flavor medium is heated, which is a function of the duration of heating and the power applied. For example, about two milligrams of TPM are typically released when 100 milligrams of the tobacco flavor medium is heated to 120° C. for 300 seconds, while about twenty-two milligrams of TPM are released when the same amount of tobacco flavor medium is heated to 280° C. for 300 seconds. Heating five milligrams of tobacco flavor medium to 300° C. for 2 seconds releases about one milligram of TPM. Thus the total TPM delivery of an article according to this invention can be controlled by selecting the amount of tobacco flavor medium as well as by tailoring heaters 110 and circuit 32 to control the temperature to which the tobacco flavor medium is heated and the rate and duration of heating.

A preferred embodiment of control circuit 32 is shown in FIG. 10. In FIG. 10, all points labelled $V_+$ are connected to the positive terminal of power source 121, and all points labelled as ground are connected to the negative terminal of power source 121.

Each heater 110 is connected to $V_+$ directly, and to ground through a respective field-effect transistor (FET) 900. A particular FET 900 will turn on under control of standard 4028-type CMOS BCD-to-decimal decoder 901 (via pins 3, 14, 2, 15, 1, 6, 7, 4). Decoder 901 is also connected (via pin 11) to the complementary output of a 4047-type CMOS timer 902 (also via pin 11). Pin 11 of decoder 901 is high when the output of timer 902 (pin 10) is low. All outputs of decoder 901 remain low if a BCD code greater than or equal to 1001 is applied to its inputs. Therefore an output of decoder 901 can only be on during a positive clock pulse to 4024-type CMOS counter 903. Decoder 901 will decode a standard BCD 4-bit code input from counter 903 into 1-of-10 outputs. Decoder 901 is connected to supply voltage $V_+$ (at pin 16) and to ground (at pin 8). Decoder 901 receives BCD input from counter 903 (at pins 10, 13, 12).

Heater-active indicators 33 (light-emitting diodes (LEDs) or other indicator devices) are connected to $V_+$ through an ADG508-type multiplexer 904 (via pins 4, 5, 6, 7, 12, 11, 10, 9) supplied by Analog Devices of Norwood, Massachusetts. LEDs 33 are connected to ground via a 2 KΩ current-limiting resistor 905. Multiplexer 904 is connected to $V_+$ (via pins 2, 13, 8) and to ground (via pins 14, 3). Multiplexer 904 receives BCD input from counter 903 (via pins 1, 16, 15). The operation of multiplexer 904 is similar to that of decoder 901 in that it receives BCD input from counter 903, and decodes it such that an individual output is selected through which $V_+$ is supplied, but in this case to LEDs 33 rather than to heaters 110.

Counter 903 is connected to $V_+$ (via pin 14) and to ground (via pins 8, 7), and receives a positive clock pulse from timer 902 (via pin 1). Counter 903 is reset to 0 via a positive pulse (through pin 2). BCD output is provided at pins 12, 11, 9, 6. Every time the clock pulse (received at pin 1) changes from positive to ground, counter 903 advances one count. Counter 903 counts positive clock pulses and converts the count to BCD. The output at pin 6 is connected to pin 6 of timer 902.

Timer 902 is in a monostable configuration and is connected to $V_+$ (via pins 4, 8, 14) and to ground (via pins 5, 7, 12, 9) for negative triggering (through pin 6). Negative triggering is accomplished by leaving pin 6 positive and then briefly pulling it to ground to initiate the timing sequence. When triggered, the complementary outputs (via pins 10, 11) change for a time period that is dependent upon resistance value R of resistor 906, preferably 2 MΩ (connected between pins 2, 3), and a capacitance value C of capacitor 907, preferably 1 μF (connected between pins 1, 3).

Puff actuator 908 is the source of the negative trigger at pin 6 of timer 902. Puff actuator 908 has two power inputs (for $V_+$ and for ground), and one output. The output drives the gate of a MOSFET switch 909. The source of MOSFET switch 909 is connected to counter 903 (at pin 6). The drain of MOSFET switch 909 is connected to timer 902 (at pin 6). Puff actuator 908 can be a device similar to silicon based pressure sensitive sensor Model 163PC01D36 referred to above, or a gas flow transducer such as a wheatstone bridge semiconductor version of a hot wire anemometer.

Resistor 910 preferably has a value of 1 MΩ, while resistors 911, 912, 913 preferably all have values of 100 KΩ. Capacitors 914, 915, 916 preferably all have values of 0.1 μF.

Prior to the smoker taking the initial puff, the control circuitry is turned on via on/off switch 917 or similar device. The heater active indicator LED 33 is illuminated for the first heater 110. Correspondingly, heater number 1 is selected by decoder 901 and awaits firing. Counter 903 is reset to begin counting. Timer 902 complementary output at pin 10 is low (which is the clock to counter 903, pin 1) and at pin 11 is high (which keeps the heater from firing via pin 11 of decoder 901). When the consumer takes a puff, puff actuator 908 causes a trigger of timer 902. The RC time constant is set by resistor 910 and capacitor 913 such that a pulse of desired duration is output from complementary outputs at pins 10, 11 of timer 902. The output from pin 11 of timer 902, connected to pin 11 of decoder 901 goes low, causing the first heater to be heated. The output at pin 10 of timer 902 stays high for the duration set by RC then goes low causing counter 903 to advance one count. The output at pin 11 returns high, discontinuing heater activation. Since the count of counter 903 has advanced by one, the heater active LED illuminated via multiplexer 904 has correspondingly advanced, and the next heater to be fired in sequence has been selected via decoder 901. This cycle will repeat until the final heater has been heated. At such time, pin 6 of counter 903 will go high causing timer 902 to become non-triggerable. In such case the heater firing sequence is halted until the circuit is reset by turning it off then on again.

Although not implemented in circuit 32 as depicted in FIG. 10, a lockout function as described above can be provided. An example of a circuit containing such a lockout function is described in copending, commonly-assigned U.S. patent application Ser. No. 07/444,818 (now U.S. Pat. No. 5,144,962), filed Dec. 1, 1989 with patent application Ser. No. 07/444,746, and hereby incorporated by reference in its entirety.

Figure 11:
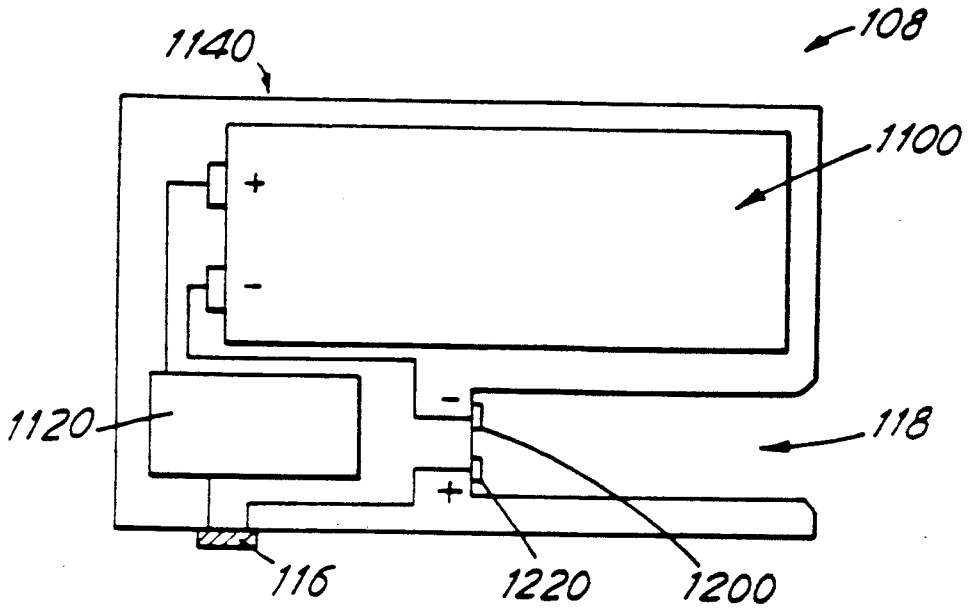
FIG. 11 is a partly schematic diagram of a device constructed in accordance with this invention for supplying electrical energy to the articles of this invention.

FIG. 11 shows an illustrative embodiment of a device used to charge the battery of power source 121 (e.g., for the article of FIG. 1). The charging device, designated generally by reference numeral 108, includes a battery 1100 and a control circuit 112, disposed within case 1114. Control circuit 1112 regulates the amount of energy delivered from battery 110 to power source 121. Charging device 108 may also include a switch 116 to permit a consumer to manually control the operation of device 108.

A recess 118 may be provided within case 1140 to accept a portion of the article (i.e., power source 121) for charging. The edges at the entrance to recess 118 typically are bevelled to facilitate positioning of the article within the passageway. Article 10 must be oriented such that the positive terminal of battery 1100 is electrically connected to the positive terminal of power source 121. Recess 118 is provided with means for ensuring proper orientation of the article when the article is placed in the recess for charging. In an illustrative embodiment, visual markings are provided on recess 118 and on the article. When the visual markings are properly aligned, the power source 121 is properly positioned for charging.

Battery 1100 of device 108 is electrically connected in series with charging contacts 1200 and 122. Contacts 120 and 122 provide a path for electricity to flow to the contacts of power source 121. Battery 1100 typically has sufficient capacity to power ten to twenty articles (i.e., battery 1100 has sufficient capacity to recharge the battery of power source 121 ten to twenty times) before battery 1100 must be recharged or replaced. Battery 1100 has a high voltage to facilitate quickly recharging power source 121. Battery 1100 typically is a rechargeable lithium or nickel cadmium battery.

When a smoker properly positions the power source portion of the smoking article within device 108, power source 121 will begin to charge. To achieve optimum charging, the charge rate and control circuitry must be tailored to the characteristics of the specific power source being charged. To reduce the waiting period and inconvenience to the smoker, a fast charging rate is desirable. In a preferred embodiment of this invention, battery 1100 charges power source 121 at approximately one-third of the capacity rate (i.e., at a rate of 83 milliamps for a 250 mAH battery pack). Charging at this faster rate, or at even faster rates (which are possible with the appropriate control circuit), necessitates the use of control circuitry to prevent overcharging and damaging power source 121.

Control circuit 1120 regulates the electrical energy transferred from battery 1100 to power source 121. Circuit 1120 permits power source 121 (e.g., a nickel cadmium battery) to be charged at a fast rate. Circuit 1120 may operate in a variety of ways. In one embodiment, circuit 1120 includes a relay which disconnects the power to contacts 1200 and 1220 when power source 121 has been charged to a predetermined level or switches to a trickle charge to maintain full charge. Power source 121 is charged to a level that is less than maximum capacity, which typically may be approximately 90 percent of capacity. In an alternative embodiment, circuit 1120 converts excess electrical energy to heat energy (i.e., circuit 1120 functions as a thermal cut-off). Other control circuits suitable for use in this invention are described in Sanyo CADNICA Technical Data Publication, No. SF6235, pp. 35–40, which is hereby incorporated by reference herein.

Figure 12:
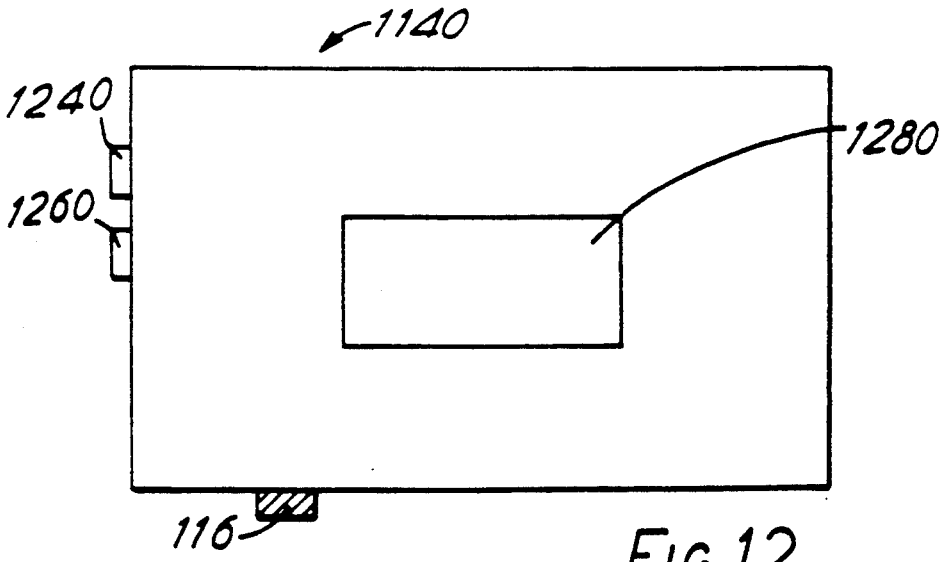
FIG. 12 is an alternative embodiment of the device of FIG. 11.

In an alternative embodiment of the invention, shown in FIG. 12, charging device 108 includes external charging contacts 1240 and 1260 disposed on the exterior of case 1140. Contacts 1240 and 1260 permit the charging of battery 1110 without requiring the battery to be removed from the case. Charging device 108 may also include clip 1280 disposed on the exterior surface of case 1140. Clip 1280 enables the smoker to carry charging device 108 by attaching it, for example, to a pocket, belt, or pocketbook.

Figure 13:
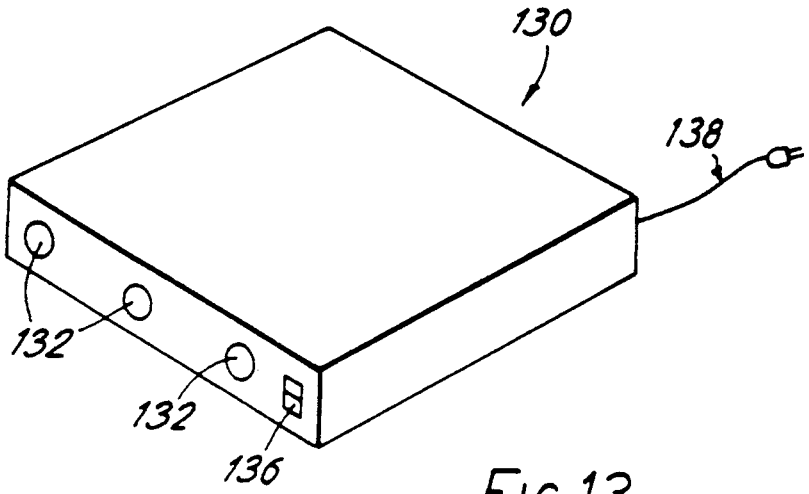
FIGS. 13 and 14 are perspective views of appliance-type devices for supplying electrical energy to the articles of this invention.
Figure 14:
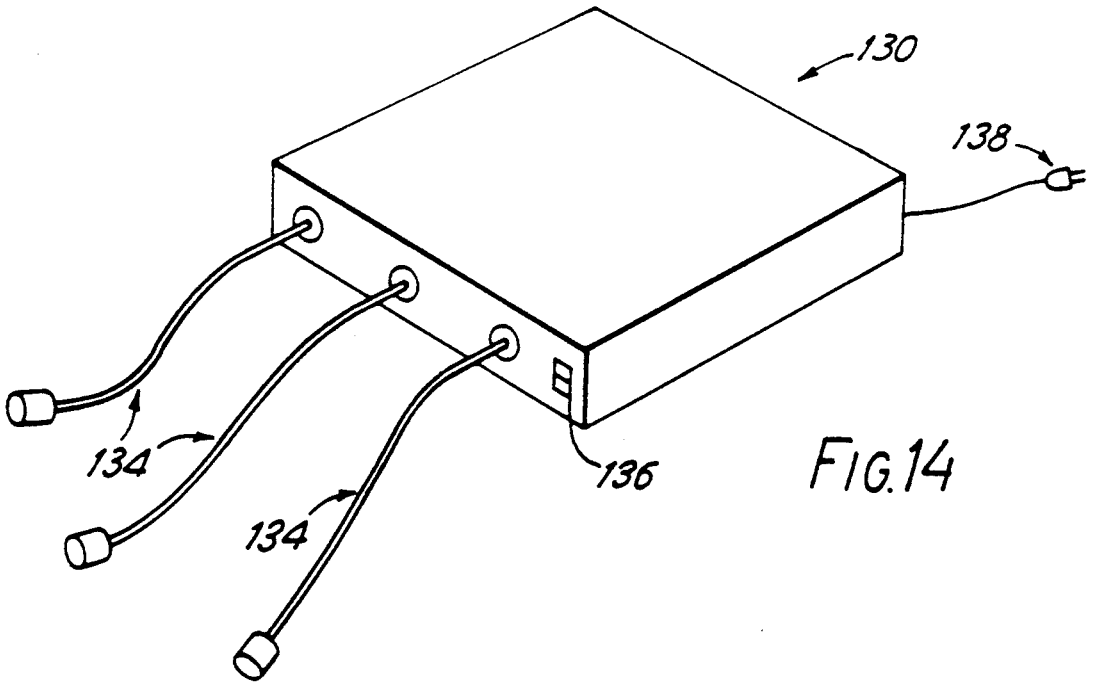

In a further embodiment of the invention, article 10 may be charged or powered using an appliance-type power unit 130 shown in FIGS. 13 and 14. Power unit 130 typically may charge a battery or capacitor within the article, or may supply power directly to the article's heating element using appropriate isolation techniques to prevent shock hazard. This could also include techniques for transferring the energy by inductive coupling, or utilizing Curie point control of the temperature reached by the heating element. Power unit 130 may be used, for example, in meeting rooms, on desktops, or whenever portability is not required. Power unit 130 has one or more recesses 132 to receive either power source 121 or article 10 or 30 having contacts 128 (FIGS. 2 and 4). Alternatively, power unit 130 includes conductive wires 134 for electrically contacts smoking articles to the power unit (via connecting 128). Wires 134 conduct electricity to the smoking article while the smoker consumer puffs on the article.

A switch 136 on power unit 130 connects and disconnects power to the articles. Power is supplied to power unit 130 via a conventional power cord and plug 138 from a conventional 120-Volt power source. Power unit 130 includes a transformer and conventional voltage regulating circuitry to provide the appropriate voltage and power output to the articles. Power unit 130 may include control circuitry similar to circuit 1120, to prevent overcharging the articles in recesses 132.

Thus it seen that an electrical smoking article which operates at a controlled temperature to produce a consistent release of tobacco flavor substance with each puff, which reaches its operating temperature quickly and provides sufficient heat to generate or release the desired tobacco flavor substance, without overheating and causing burning of its tobacco flavor medium, which is self-contained, and which can have the appearance of a conventional cigarette, is provided. One skilled in the art will appreciate that the present invention can be practiced by other than the described embodiments, which are presented for purposes of illustration and not of limitation, and the present invention is limited only by the claims which follow.

What is claimed is:

1. In combination:

(a) an electrical smoking article for delivering to a smoker an inhalable tobacco flavor substance, said article comprising:
- a plurality of pre-measured charges of tobacco flavor medium,
- electrical heating means for individually heating each of said plurality of charges,
- internal storage means for storing electrical energy for powering said electrical heating means,
- electrical contacts for applying electrical energy to said internal storage means, and
- control means for selectively applying said electrical energy to said electrical heating means to selectively heat said plurality of charges in a predetermined sequence, each of said charges being heated only once and, when heated, delivering a predetermined quantity of tobacco flavor substance to said smoker; and (b) apparatus for supplying electrical energy to said electrical contacts, said apparatus comprising:
- means for supplying electrical energy,
- means for containing said means for supplying electrical energy, and
- means for making electrical contact between said means for supplying electrical energy and said electrical contacts of said article, to charge said internal storage means of said electrical smoking article.

2. The combination of claim 1 wherein:

said electrical contacts of said electrical smoking article are on the exterior surface of said electrical smoking article;

said apparatus has a recess therein;

said means for making electrical contact of said apparatus are disposed within said recess; and said electrical smoking article is inserted into said recess of said apparatus to make electrical contact between said electrical contacts of said electrical smoking article and said means for making electrical contact of said apparatus.

3. The combination of claim 1 wherein:

said electrical contacts of said electrical smoking article are on the exterior surface of said electrical smoking article;

said means for making electrical contact of said apparatus are disposed on the exterior surface of said apparatus; and said article is held adjacent said exterior surface of said apparatus to make electrical contact between said electrical contacts of said electrical smoking article and said means for making electrical contact of said apparatus.

* * * * *